US005749539A

United States Patent [19]

Ratzel et al.

[11] Patent Number: 5,749,539

[45] Date of Patent: May 12, 1998

[54] DUNNAGE-CREATING MACHINE WITH PLUGLESS PAPER ROLL AND METHOD

[75] Inventors: Richard O. Ratzel, Westlake, Ohio; Dirk Johannes Siekmann, Sittard, Netherlands

[73] Assignee: Ranpak Corp., Concord Township, Ohio

[21] Appl. No.: 267,960

[22] Filed: Jun. 29, 1994

[51] Int. Cl.[6] ..... B65H 16/02; B65H 19/12; B65H 75/22

[52] U.S. Cl. ..... 242/598.3; 242/599.1; 242/599.2; 242/599; 242/588.2; 294/158; 294/168

[58] Field of Search ..... 242/599.2, 599.1, 242/599.3, 598.3, 598.4, 594.3, 578, 557, 599, 599.4, 129.6, 129.62, 915; 414/911; 294/1.1, 26, 137, 145, 168, 169, 158, 170

[56] References Cited

U.S. PATENT DOCUMENTS

| | | | |
|---|---|---|---|
| 508,801 | 11/1893 | Baker et al. | 242/578 |
| 1,028,506 | 6/1912 | Thieme | 242/129.6 |
| 1,403,123 | 1/1922 | Leedy | 242/129.6 |
| 1,570,190 | 1/1926 | Williams | 242/599.2 |
| 1,823,164 | 9/1931 | Pope | 242/599.2 |
| 1,902,751 | 3/1933 | Bauman | 242/599.1 |
| 3,374,964 | 3/1968 | Carvotta | 242/599.1 |
| 3,743,203 | 7/1973 | Rancourt | 242/599.2 |
| 3,938,806 | 2/1976 | Husbands | 242/588.2 |
| 4,026,198 | 5/1977 | Ottaviano . | |
| 4,191,342 | 3/1980 | Reinhold | 242/599.3 |
| 4,333,617 | 6/1982 | Hamilton . | |
| 4,530,473 | 7/1985 | Parry | 242/588.2 |
| 4,610,123 | 9/1986 | Krone et al. | 242/599.2 |
| 4,650,456 | 3/1987 | Armington . | |
| 4,741,490 | 5/1988 | Evans | 242/599.2 |
| 4,799,721 | 1/1989 | Hale | 242/588.2 |
| 5,061,543 | 10/1991 | Baldacci . | |
| 5,143,316 | 9/1992 | Goetz et al. | 242/598.3 |
| 5,188,581 | 2/1993 | Baldacci . | |
| 5,322,231 | 6/1994 | Greenberg et al. | 242/588.2 |
| 5,322,234 | 6/1994 | Robert et al. . | |
| 5,322,477 | 6/1994 | Armington et al. . | |

FOREIGN PATENT DOCUMENTS

| | | | |
|---|---|---|---|
| 0031186 | 7/1981 | European Pat. Off. . | |
| 0055422 | 7/1982 | European Pat. Off. . | |
| 1762360 | 9/1992 | U.S.S.R. | 242/599.2 |

*Primary Examiner*—John M. Jillions
*Attorney, Agent, or Firm*—Renner, Otto, Boisselle & Sklar, P.L.L.

[57] ABSTRACT

A cushioning conversion machine of the type that converts sheet-like stock material into resilient-like dunnage product has associated therewith a stock roll holder and loading method characterized by a pair of laterally spaced apart mounts and a stock roll holder having opposite end portions removably supported on the mounts. The stock roll holder includes first and second holder portions each including a spindle member having an axially outer portion forming a respective one of the opposite end portions of the holder, a core insert rotatably supported on and axially carried by the spindle member for telescopic insertion into the hollow core of the stock roll at an adjacent end thereof thereby to support the stock roll for rotation with the core insert, and an axial abutment axially carried on the spindle member axially outwardly of the core insert and projecting radially outwardly beyond the core insert to form an abutment for engaging the adjacent axial end of the stock roll thereby to limit axial outward movement of the stock roll relative to the spindle member.

38 Claims, 11 Drawing Sheets

DUNNAGE-CREATING MACHINE WITH PLUGLESS PAPER ROLL AND METHOD

The invention herein described relates generally to a dunnage-creating machine such as a cushioning conversion machine for producing resilient pad-like dunnage product from sheet-like stock material supplied in roll form and, more particularly, to an improved device and method for facilitating the loading of a roll of stock material onto a roll support at the upstream end of the dunnage-creating machine.

BACKGROUND AND SUMMARY OF THE INVENTION

In the process of shipping an item from one location to another, a protective packaging material is typically placed in the shipping case, or box, to fill any voids and/or to cushion the item during the shipping process. Some conventional protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alternative. Paper is biodegradable, recyclable and renewable, making it an environmentally responsible choice for conscientious industries.

While paper in sheet form could possibly be used as a protective packaging material, it is usually preferable to convert the sheets of paper into a pad-like or other dunnage product. This conversion may be accomplished by a cushioning conversion machine, such as that disclosed in commonly assigned U.S. Pat. No. 4,968,291. The therein disclosed cushioning conversion machine converts sheet-like stock material, such as paper in multi-ply form, into a pad-like dunnage product having longitudinally extending pillow-like portions that are connected together along a stitched central portion of the product. The stock material preferably consists of three superimposed webs or layers of biodegradable, recyclable and reusable thirty-pound Kraft paper rolled onto a hollow cylindrical tube. A thirty-inch wide roll of this paper, which is approximately 450 feet long, will weigh about 35 pounds and will provide cushioning equal to approximately four fifteen cubic foot bags of plastic foam peanuts while at the same time requiring less than one-thirtieth the storage space.

The multi-ply roll of sheet-like stock material is mounted, for example, at the upstream end of the conversion machine by means of an axle rod that passes through the core of the stock roll with its ends projecting therebeyond for cradled receipt in respective laterally spaced apart mounts of a roll support. The mounts may be provided, for example, directly on the main frame of the cushioning conversion machine as shown in the '291 patent or on a mobile cart as shown in commonly assigned U.S. Pat. No. 4,650,456.

The stock rolls presently used in cushioning conversion machines of the foregoing type have a 3 inch (7.62 cm) cardboard core tube around which multiple plies of the sheet material are tightly wrapped. A common practice has been to insert into each end of the core tube a disposable plastic plug that accommodates a difference between the inner diameter of the core tube and the outer diameter of the axle rod used to support the stock roll at the upstream end of the cushioning conversion machine. The plastic plugs in use today have concentric cylindrical outer and inner walls that are interconnected by an axially inner annular wall and radial ribs that extend radially between the radially inner and outer walls. The radially outer wall is sized for close fitted insertion into the core tube of the stock roll and there is provided at the axially outer end thereof a radially projecting annular flange which functions to engage the end of the core tube to prevent over insertion of the plug into the core tube. The radially inner cylindrical wall has an inner diameter closely corresponding to the outer diameter of the axle rod for smooth rotation of the plug about the axle rod.

A stock roll would typically be loaded by positioning a stock roll on the floor or on a stand near the cushioning conversion machine. The axle rod would then be inserted into the center hole in the plug at one end of the roll, through the core tube and then through the center hole in the plug at the opposite end of the roll. The stock roll could then be raised by grasping and lifting the ends of the axle rod that projected from opposite ends of the stock roll. The loading operation is completed by lowering the projecting ends of the axle rod onto the laterally spaced apart mounts that had recesses for cradled receipt and retention of the axle rod.

Although the above mentioned arrangement for supporting and loading a stock roll is functionally adequate, it would be desirable to eliminate the need for the plastic plugs and thus problems associated therewith such as the plugs on occasion falling out of the core tubes. In addition to providing cost and labor savings, the elimination of disposable plastic parts would be more environmentally responsible.

Moreover, it would be desirable to eliminate the need for the plastic plugs while making loading of a stock roll easier. With the above mentioned arrangement, threading of the axle rod through the similarly sized center holes in the plastic plugs has been a somewhat tedious task.

The present invention provides a novel stock roll holder and loading method for a dunnage-creating machine that produces dunnage product from sheet-like stock material supplied as a roll having a hollow core. The novel holder and method eliminate the need for the previously used disposable plastic plugs while providing various advantages including easier loading of the stock roll onto a roll support at the upstream end of the cushioning conversion machine. Also, in certain embodiments, the holder, or other type of spindle, has at each end thereof a handle that folds away after loading of a stock roll to avoid interference during operation of the machine.

According to the invention, there is provided in a dunnage-creating machine of the aforesaid type a stock roll support assembly for rotatably supporting a roll of sheet-like stock material from which the sheet-like stock material is payed off for conversion by the machine into a dunnage product. The stock roll support assembly comprises a pair of laterally spaced apart mounts and a stock roll holder having opposite end portions removably supported on the mounts. The stock roll holder includes first and second holder portions each including a spindle member having an axially outer portion forming a respective one of said opposite end portions of the holder, a core insert rotatably supported on and axially carried by the spindle member for telescopic insertion into the hollow core of the stock roll at an adjacent end thereof thereby to support the stock roll for rotation with the core insert, and an axial abutment axially carried on the spindle member axially outwardly of the core insert and projecting radially outwardly beyond the core insert to form an abutment for engaging the adjacent axial end of the stock roll thereby to limit axial outward movement of the stock roll relative to the spindle member. With multi-ply stock rolls, the dunnage-creating machine preferably is provided with a separating mechanism to separate the plies prior to conversion into a dunnage product.

According to another aspect of the invention, a stock roll holder includes a composite spindle composed of two interconnectable but separable spindle members having axially outer portions respectively forming the opposite end portions of the holder that are supported on the laterally spaced apart mounts, and a stock roll core support rotatably supported on the composite spindle and axially carried by least one of the separable spindle members. Each spindle member axially carries thereon an abutment for engaging a respective end of the stock roll to limit axially outward movement of the stock roll relative to the spindle member.

According to a preferred embodiment of the invention, the stock roll core support includes a pair of core inserts respectively supported on and axially carried by the spindle members. Each core insert is sized for close-fitted receipt in the hollow core of the stock roll and preferably has formed integrally therewith the abutment that engages the respective end of the stock roll to limit axially outward movement of the stock roll core relative to the respective spindle member. Preferably each core insert is formed as a unitary body made of a bearing material that provides an integral bearing surface at a central hole therein through which the spindle member extends, thereby to provide for relatively friction-free rotation of the core insert on the spindle member. The invention, however, also contemplates the provision of discrete bearings, such as a bushings, for rotatably supporting on the spindle members the core inserts that may be made of other materials. Further in accordance with the preferred embodiment, axial stops are provided on the spindle members to limit axial movement of the core inserts relative to the spindle members, and the separable spindle members have axially inner portions that telescopically mate to join the spindle members together to form a composite spindle for lifting and mounting of a stock roll carried thereon to the dunnage-creating machine.

According to a further aspect of the invention, a method for loading and supporting a hollow core stock roll in operative relation to a dunnage-creating machine for producing dunnage product from sheet-like stock material payed off of the stock roll, comprises the steps of inserting first and second spindle members into the hollow core of the stock roll from opposite ends of the stock roll while leaving axially outer end portions of said spindle members projecting beyond the axial ends of the stock roll, and supporting the projecting end portions of the spindle members in laterally spaced apart mounts. Preferably, core inserts axially carried on the spindle members are used for rotatably supporting the stock roll on the spindle members, axial stops are positioned axially outwardly of the ends of the stock roll for limiting axially outer movement of the stock roll relative to the spindle members when supported on the mounts. As above mentioned, the first and second spindle members are coupled together, as by telescopic insertion of one into the other, when the latter are inserted into opposite ends of the stock roll core to form a composite spindle that will be supported at opposite end portions thereof when the spindle members are supported by the mounts. The method may also include the step of separating multiple plies of sheet-like stock material payed off of a multi-ply stock roll for passage through a separating mechanism that separates the plies during operation of the dunnage-creating machine.

The invention also provides as features thereof, at each end of the holder or other spindle, a swing handle or a telescopically retractable and extendable handle. Both handles facilitate loading while being movable to an out of the way position when otherwise not needed, as during operation of the dunnage-creating machine.

The foregoing and other features of the invention are hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION

Figure 1:
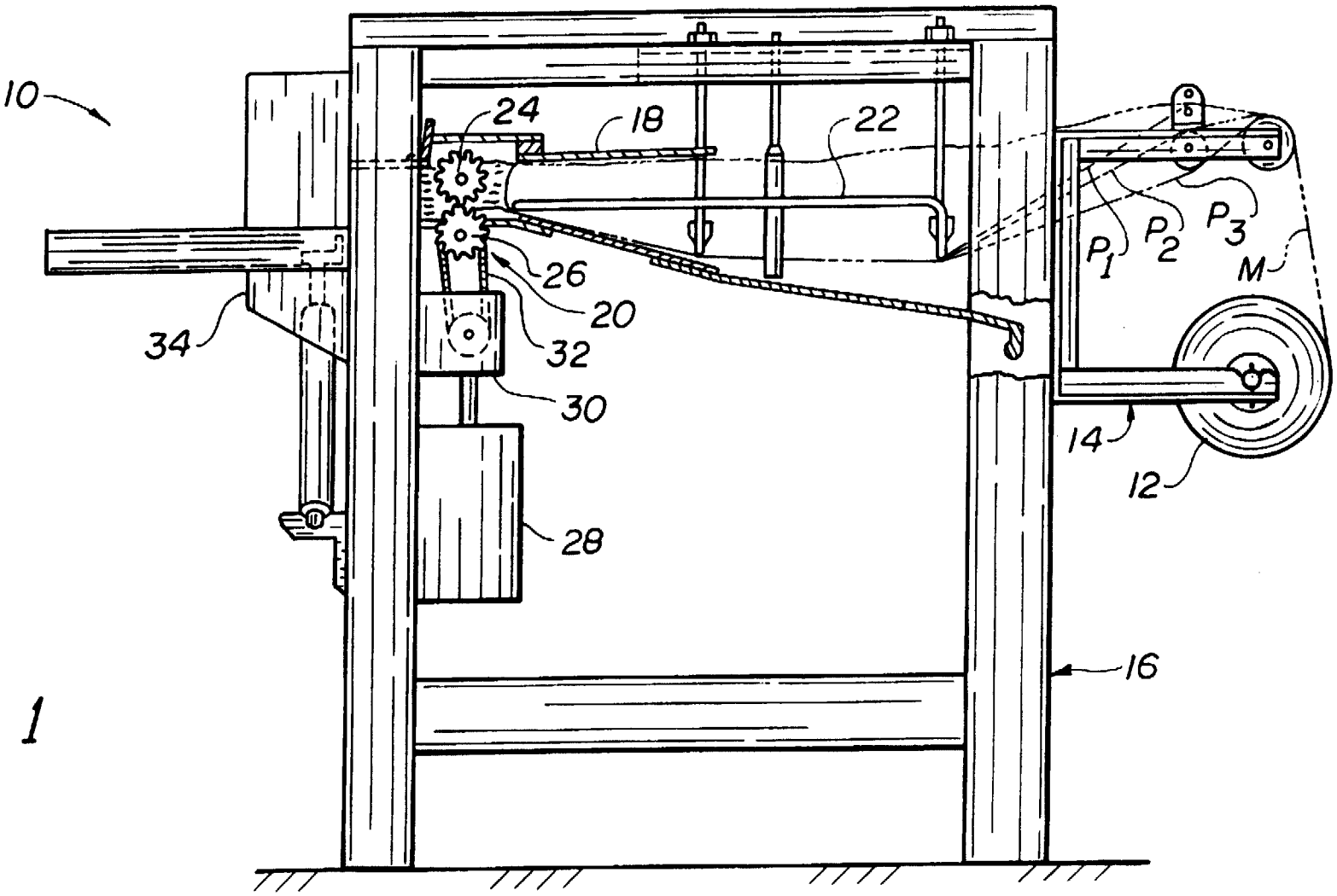
FIG. 1 is a side elevational view, partly broken away in section, of a dunnage-creating machine embodying the present invention.

Referring now in detail to the drawings and initially to FIG. 1, there is illustrated a dunnage-creating machine and, more particularly, a cushioning conversion machine 10 that converts sheet-like stock material M payed off from a stock roll 12 into a resilient pad-like dunnage product. The stock roll 12 is rotatably supported by a stock roll support assembly which is hereinafter described in greater detail. However, it is here noted that the stock roll support assembly in the cushioning conversion machine 10 is in part formed by a framework 14 that is secured to a main frame 16 of the machine 10, which main frame 16 preferably, although not shown, is enclosed by sheeting as is conventional. The main frame 16 supports a longitudinally converging chute-like member 18 that forms a guide and support for plies $P_1$, $P_2$ and $P_3$ of the stock material as they are passed toward a connecting or stitching mechanism 20.

A three-dimensional stock forming frame 22 is supported in the chute 18 and projects from of the entry end of the chute. As the plies $P_1$–$P_3$ of sheet-like stock material are pulled over the stock forming frame and through the converging chute, the side edges of the ply sheets are rolled inwardly into generally spiral form and are urged inwardly toward one another so that inwardly rolled edges thereof form resilient pillow-like or pillow-shaped portions of stock material disposed in generally abutting relationship as they merge from the exit end of the chute 18 and pass into the stitching mechanism 20.

The stitching mechanism 20 comprises loosely meshed gear-like members 24 and 26 that are rotatably driven by an electric motor 28 through a speed reducer 30 and chain drive 32. The loosely meshed gear-like members 24 and 26 cooperate to stitch, as by coining, the abutting lateral pillow-like or pillow-shaped portions of the rolled stock material passing therebetween from the converging chute 18. The result is a pad-like cushioning product having a compressed central coined portion joining together resilient pillow-like portions that primarily contribute to the cushioning properties of the product. The product passing from the stitching mechanism 20 may be severed by a cutter mechanism 34 to cut the continuously formed strip of produced dunnage product into desired lengths.

For a more detailed disclosure of the cushioning conversion machine of FIG. 1, reference may be had to commonly assigned U.S. Pat. Nos. 4,750,896 and 4,968,291, the disclosures of which are hereby herein incorporated by reference.

Figure 3:
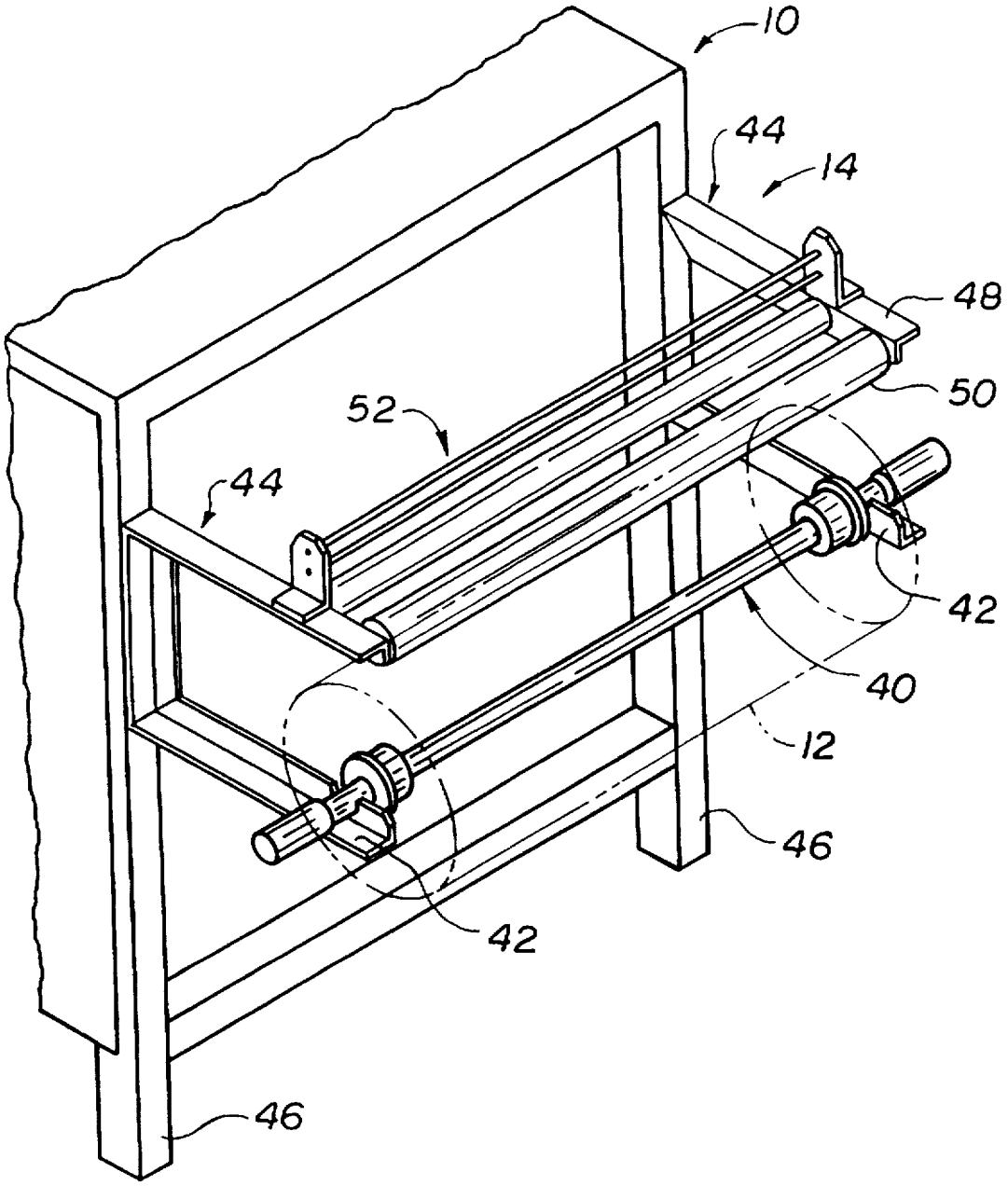
FIG. 3 is an enlarged fragmentary isometric view of the upstream or loading end of the dunnage-creating machine of FIG. 1, showing a stock roll holder according to the present invention.

Referring now to FIG. 3, the framework 14 at the upstream or loading end of the cushioning conversion machine 10 is shown in combination with a stock roll holder 40 according to the invention. As shown, the stock roll 12 is supported centrally on the stock roll holder 40 which has end portions projecting beyond the ends of the stock roll for removable support on laterally spaced apart mounts 42. In the cushioning conversion machine of FIGS. 1 and 3, the laterally spaced apart mounts 42 are formed by the lower legs of U-shaped brackets 44 that form respective sides of the framework 14. The U-shaped brackets are turned on their sides with the bight portions thereof secured to respective upright legs 46 of the main frame 16.

As seen in FIGS. 1 and 3, the upper legs 48 of the brackets 44 have journalled between the ends thereof a roller 50 that provides a non-varying point of entry for the sheet-like stock material M from the stock roll 12. The upper legs 48 also support therebetween a separating mechanism 52 which receives the sheet-like stock material M from the roller 50 and separates the multiple plies $P_1$–$P_3$ from one another prior to passing beneath the forming frame 22 and into the converging chute 18. For further details concerning the entry roller 50 and separating mechanism 52, reference may be had to U.S. Pat. No. 4,750,896.

Figure 2:
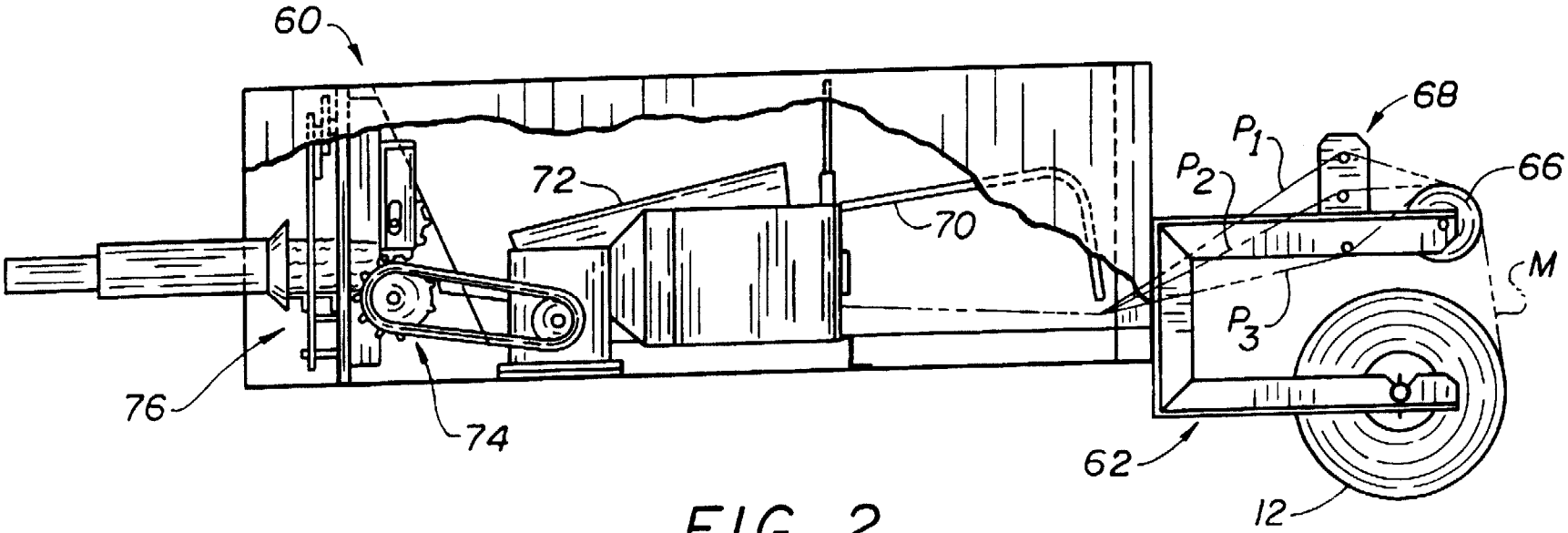
FIG. 2 is a side elevational view, partly broken away in section, of another version of dunnage-creating machine embodying the present invention.
Figure 4:
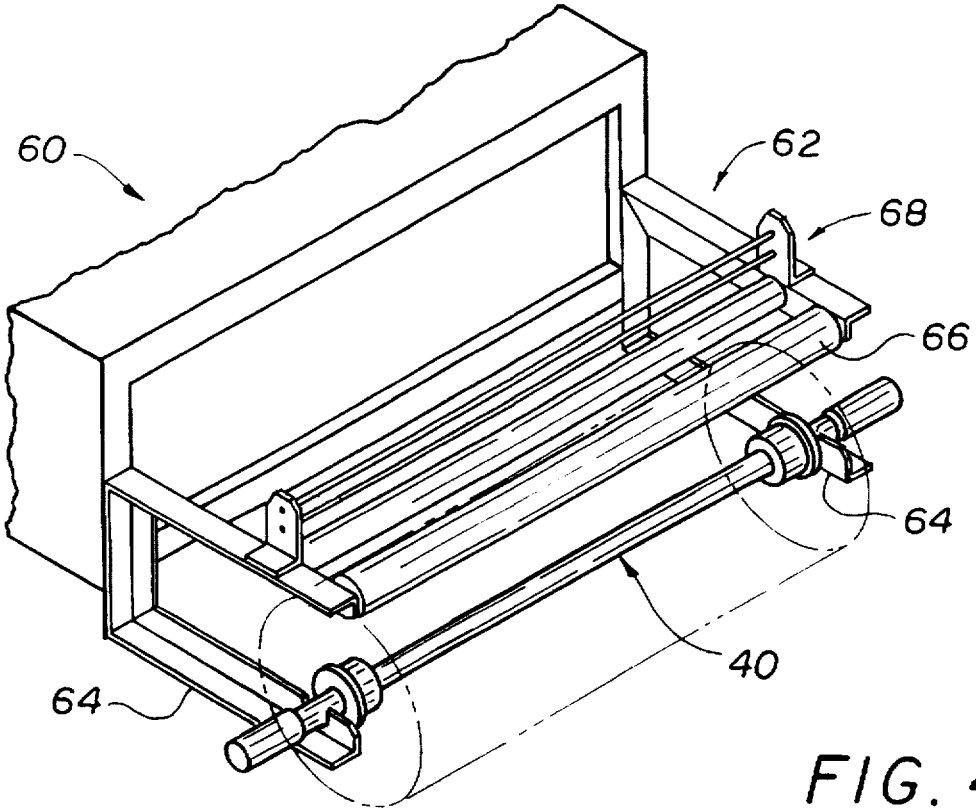
FIG. 4 is an enlarged fragmentary isometric view of the upstream or loading end of the dunnage-creating machine of FIG. 2, showing the stock roll holder in combination therewith.

Referring now to FIGS. 2 and 4, the stock roll holder 40 may be similarly used in another version of cushioning conversion machine designated by reference numeral 60. While the cushioning conversion machine 10 of FIGS. 1 and 3 is primarily designed as a self-standing unit, the machine 60 of FIGS. 2 and 4 is designed to be easily positioned in both a horizontal and vertical manner to facilitate incorporation into a variety of packaging systems. However, for purposes of the present invention, the machines 10 and 60 are functionally equivalent. In this regard, it is noted that similar to the machine 10, the machine 60 has at its upstream or loading end a framework 62 which provides laterally spaced apart mounts 64 for supporting the projecting end portions of the stock roll holder 40. The framework 62 also supports an entry roller 66 and separating mechanism 68 which guide and separate the plies $P_1$–$P_3$ of the stock material M that is payed off of the stock roll 12. The machine further comprises a stock forming frame 70, a converging chute 72, a stitching mechanism 74 and a cutter mechanism 76. For further details of the machine 60, reference may be had to commonly assigned U.S. Pat. No. 5,123,889 and co-pending Simmons U.S. patent application No. 08/188,305, filed Jan. 28, 1994 and entitled "Cushioning Conversion Machine Including A Cutting/Aligning Assembly", all of which are hereby incorporated herein by reference.

Figure 5:
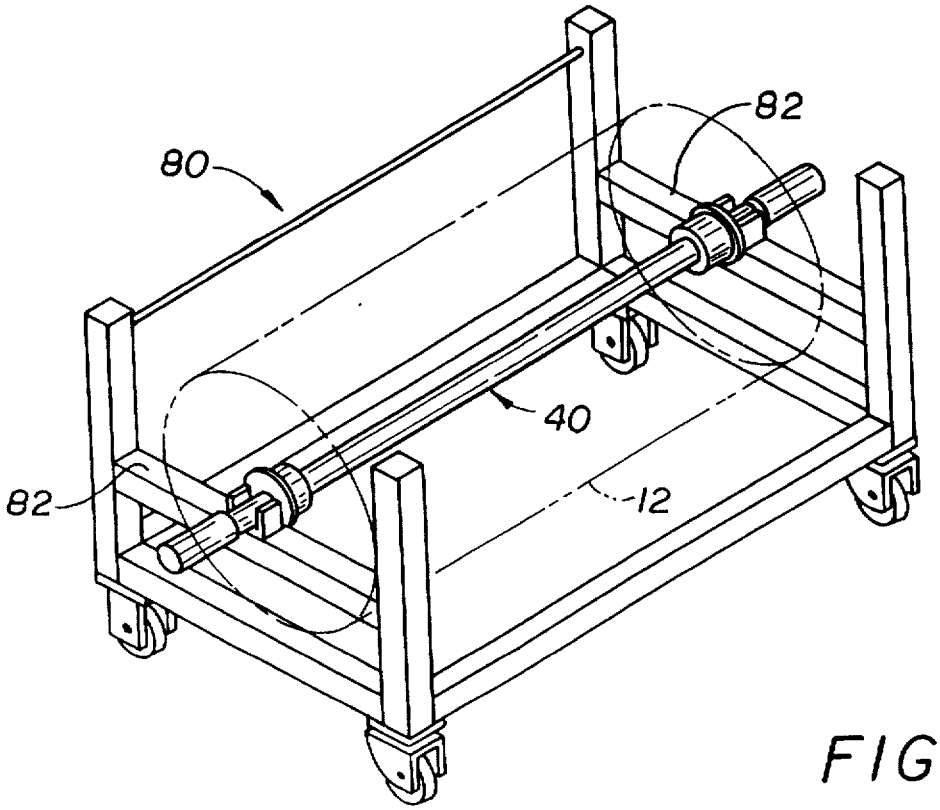
FIG. 5 is an isometric view showing use of the stock roll holder with a stock roll support cart that may be used, for example, with the dunnage-creating machine of FIG. 1.

Referring now to FIG. 5, another application of the stock roll holder 40 is exemplified, this one being in combination with a stock roll cart 80 that functions as a mobile carrier for a stock roll 12. The mobile cart 80 has particular advantage in handling larger stock rolls of material which may weigh, for example, 105 pounds (47.7 kg). For details of the mobile cart and its use with a cushioning conversion machine, reference may be had to commonly assigned U.S. Pat. No. 4,650,456, which is hereby incorporated herein by reference. However, it is here noted that for purposes of the present invention, the cart 80 comprises a pair of laterally spaced apart mounts 82 for supporting in the hereinafter described manner the end portions of the stock roll holder 40 that project beyond the ends of the stock roll 12. Moreover, the cart, when used with cushioning conversion machine, in effect forms a part of the cushioning conversion machine.

Figure 6A:
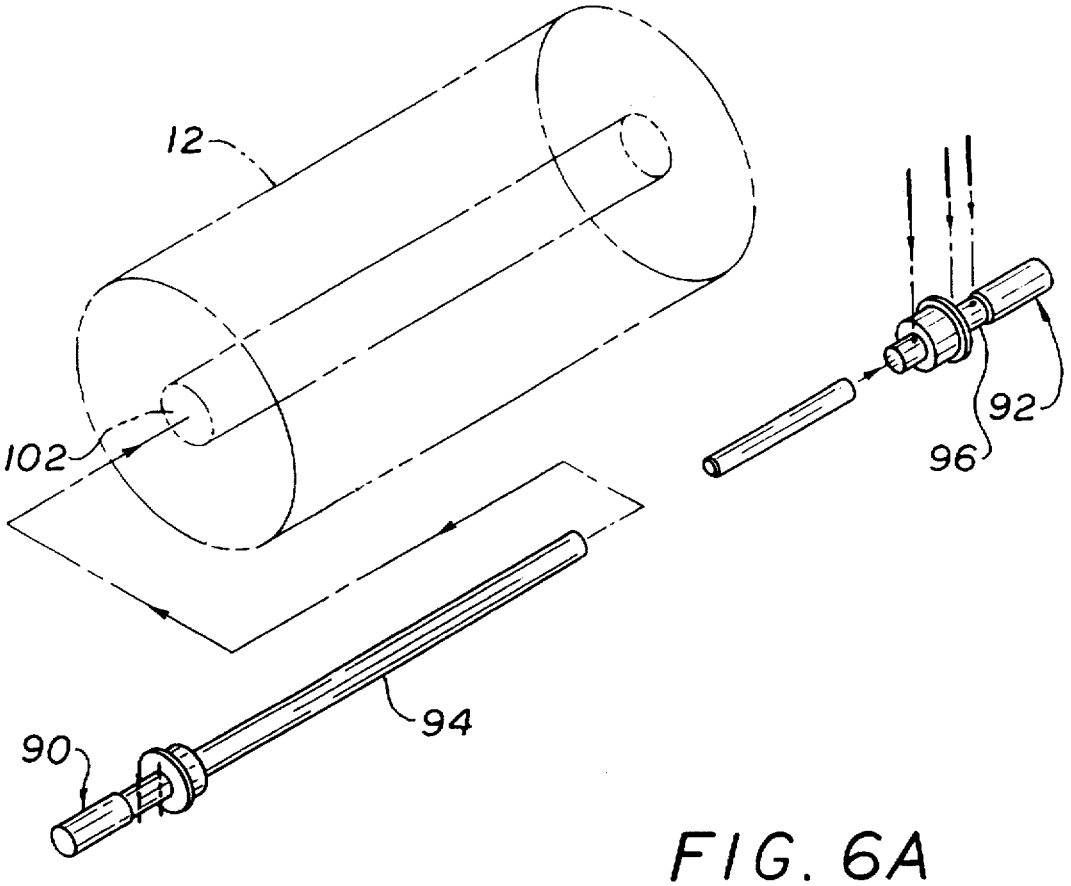
FIG. 6A is an exploded isometric view of the stock roll holder.
Figure 6B:
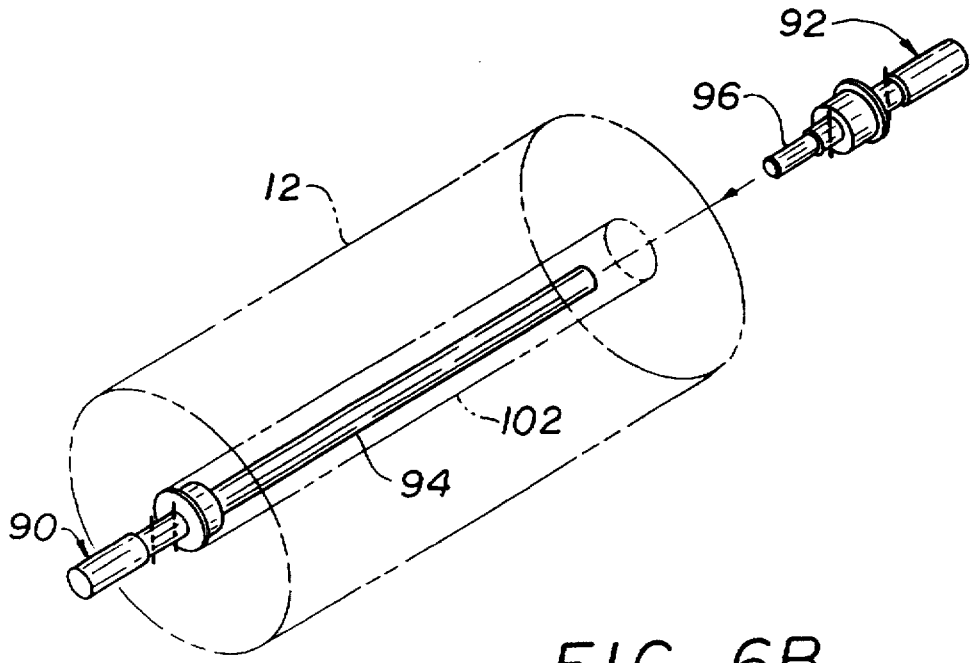
FIG. 6B is an isometric view illustrating mounting of a stock roll with respect to the stock roll holder.

Having above described several exemplary uses of the stock roll holder 40 according to the invention, details of the stock roll holder will now be described with reference to FIGS. 6A–6C, 7 and 8. As shown, the stock roll holder 40 comprises first and second holder portions 90 and 92 as best shown in FIG. 6B. The holder portions 90 and 92 include respective spindle or axle members 94 and 96 which rotatably support and axially carry respective core inserts 98 that preferably are identical. The core inserts 98 are configured for close fitted receipt within the ends of the hollow core 102 of the stock roll 12. The hollow core 102 of the stock roll may be formed, for example, by a cardboard core tube or by the innermost turns of stock material in a stock roll that does not employ a core tube. As above mentioned a typical core tube diameter is 3 inches (7.62 cm), but other diameters of core tubes or cores are also contemplated.

Figure 6C:
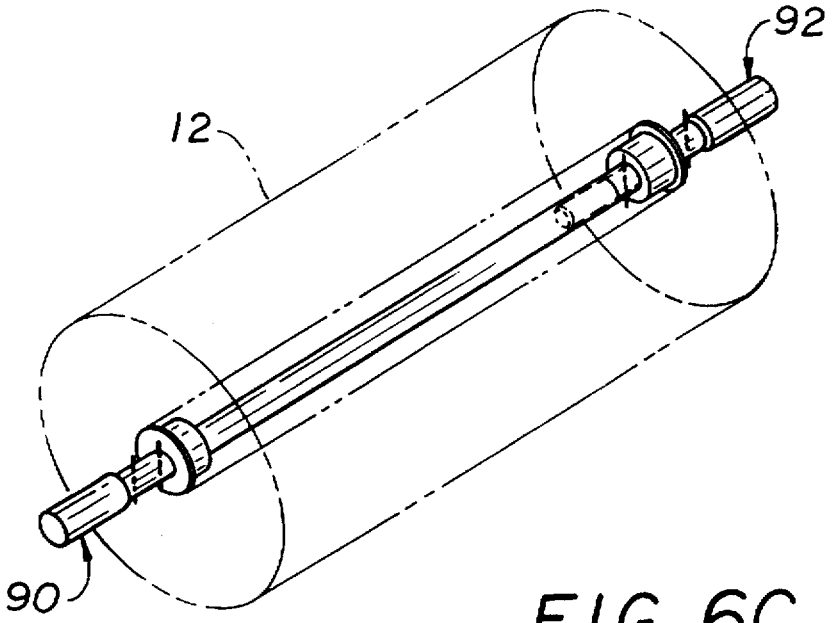
FIG. 6C is an isometric view showing the stock roll holder mounted with respect to a stock roll holder.
Figure 7:
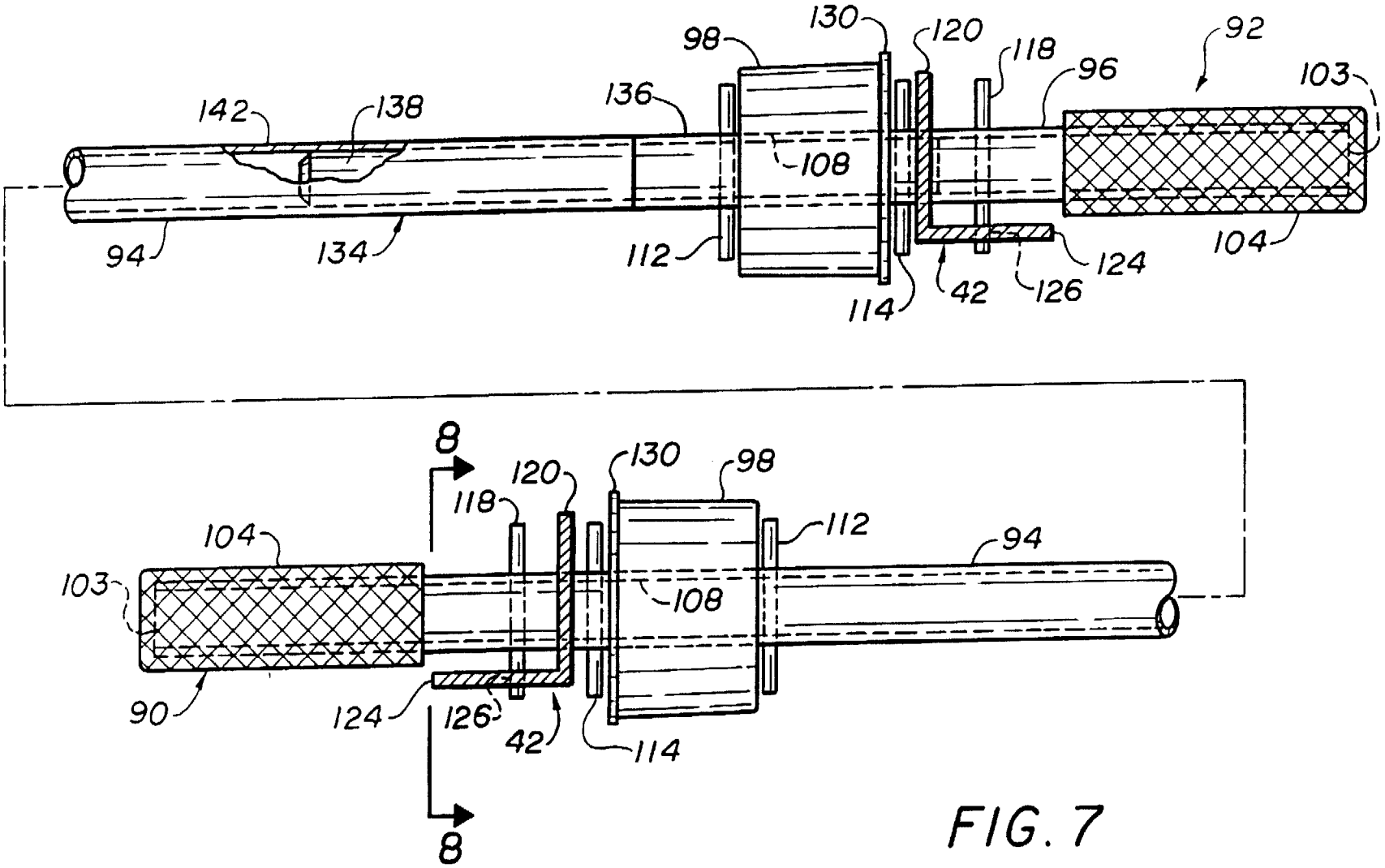
FIG. 7 is an enlarged fragmentary elevational view of the stock roll holder as assembled and mounted with respect to laterally spaced apart mounts of a stock roll support.

When the core inserts 98 are inserted into respective ends of the hollow core 102 of the stock roll 12 as shown in FIGS. 6C and 7, axially outer end portions of the spindle members 94 and 96 project axially beyond the ends of the stock roll to form end portions of the stock roll holder 40 that are supported in laterally spaced apart mounts of the cushioning conversion machine, such as the mounts 42 of the cushioning conversion machine 10. At its outermost end portion each spindle member forms a handle 103 that may be provided with a grip 104 to provide for comfortable and/or secure gripping of the spindle member ends thereby to facilitate loading of a stock roll in the hereinafter described manner. The grips 104 preferably are rubber or plastic slip-on grips, although other types of grips may be employed such as grips formed by knurling the ends of the spindle members or molded on plastic or rubber grips. If desired, the grips may be provided on spindle extensions that may be folded transversely to the spindle member or otherwise moved out of the way after the stock roll holder has been loaded on the mounts, as in the hereinafter described manner. Preferably, the grips are a bright color, such as red, yellow. Also, the grips at opposite ends of the holder may be of different colors to distinguish between the spindle members.

Figure 8:
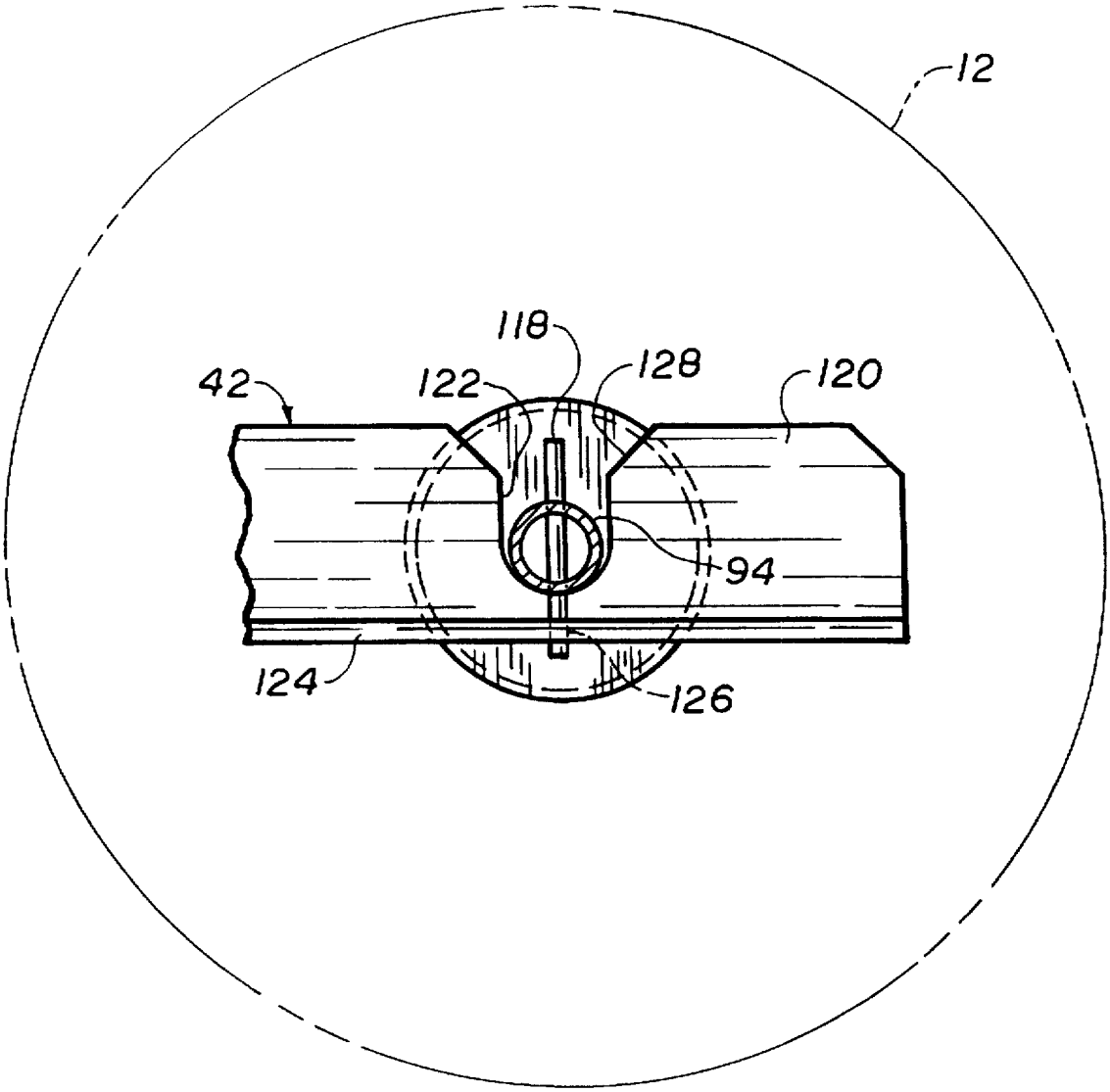
FIG. 8 is a cross-sectional view taken along the line 8—8 of FIG. 7.

As best seen in FIGS. 7 and 8, each core insert 98 preferably is a tubular body having an outer diameter that provides for close fitted receipt within the hollow core of the stock roll. As will be appreciated, different diameter core inserts may be used with different diameter stock roll cores. The core insert body also has a center hole 108 through which the respective spindle member 94, 96 extends. Preferably, the core insert is made of a bearing material, such as nylon, that provides an integral bearing surface at the center hole through which the spindle member extends thereby to provide for relatively friction free rotation of the core insert on the spindle member. The invention, however, also contemplates the provision of discrete bearings, such as a bushings, for rotatably supporting on the spindle members the core inserts that may be made of other materials.

Axial movement of each core insert 98 relative to the respective spindle member 94, 96 is limited by inner and outer axial stops 112 and 114 on the spindle member. In the illustrated preferred embodiment, the axial stops 112 and 114 are formed by inexpensive pins that extend diametrically through the spindle member and radially beyond to form abutments at opposite axial ends of the core insert. In this manner, the core insert is axially carried on the spindle member (will be carried with the spindle member as when axially removed from a stock roll core tube) while still being free to rotate on the spindle member. Any suitable means may be employed to secure the pins (as well as the other herein mentioned pins) to the spindle member such as by press-fitting them in undersized holes in the spindle member, by welding, etc.

Each spindle member 94, 96 also has another pin 118 extending therethrough and radially outwardly at a position spaced axially outwardly of the outer stop or pin 114. This pin 118 is provided to prevent rotation of the spindle member when supported on the respective mount 42. As shown in FIGS. 7 and 8, each mount 42 may be formed by an angle member having formed in its upright leg 120 a recess 122 for closely receiving the respective spindle member. The lower leg 124 of the angle member has formed therein an opening or aperture 126 to receive the end of the pin 118 to prevent the spindle member from rotating relative to the mount. It is noted, however, that other means may be employed to prevent rotation of the spindle member relative to the mount, such as other radial interference means such as flats on diametrically opposite sides of the spindle member which coact with the generally parallel sides of the recess 122 to prevent the spindle member from turning in the recess. As shown in FIG. 8, the recess 122 in the upright leg of the angle member may have a wide tapered mouth 128 to facilitate guiding of the spindle member into the relatively narrow lower portion of the recess which closely cradles the spindle member against horizontal movement perpendicular to the longitudinal extent or axis of the spindle member.

As further shown in FIGS. 7 and 8, each core insert 98 preferably has integrally formed therewith an axial abutment 130 that projects radially outwardly of the core insert for engaging the axial end of the stock roll thereby to limit axial outward movement of the stock roll relative to the core insert and hence the respective spindle member. The axial abutment preferably is in the form of a radially projecting flange at the axially outer end of the core insert. However, other arrangements may be employed to limit axial movement of the stock roll relative to the spindle member. By way of example, a discrete washer having an outer diameter greater than that of the insert (and more particularly the inner core diameter of the stock roll) may be interposed between the insert and an axial stop on the spindle member such as the pin 114.

The spindle members 94 and 96 preferably are coupled together to form a composite spindle 134. Any suitable means may be employed to provide for coupling together of the spindle members while permitting separation thereof for mounting with respect to a stock roll. Preferably, the spindle members have axially inner portions that telescopically mate to join the spindle members together. In the illustrated embodiment, one of the spindle members, preferably the shorter 96 of two different length spindle members, is formed by a tubular member 136 and an extension rod member 138 which has part thereof extending into the tubular member 136 and fixed therein by suitable means such as by the above mentioned pins 112 and 114 that pass through both the tubular member and the extension rod member. The rod member projects axially inwardly beyond the tubular member for close fitted receipt within a tubular member 142 forming the longer spindle member 94. In this manner the spindle members are telescopically interconnected to form a continuously rigid composite spindle 134. However, for mounting and demounting with respect to a stock roll, the spindle members are axially separable. When the stock roll holder is properly supported on the mounts, the mounts will preclude separation of the spindle members as should be immediately evident from FIG. 7.

According to the method of the present invention, a stock roll is loaded by positioning a stock roll usually horizontally on the floor or on a stand near the cushioning conversion machine (or a cart such as the cart shown in FIG. 5 which can be loaded and then rolled into position for supplying the stock material to a cushioning conversion machine). This allows the holder portions 90 and 92 to be inserted into the hollow core of the stock roll from opposite axial ends thereof.

Preferably the holder portion 90 with the longer spindle member is first inserted into one end of the hollow core sufficiently to fully insert the core insert thereon with the annular abutment or flange 130 thereof being engaged with the end of the stock roll.

This will position the axially inner end of the spindle member 94 in close proximity to the opposite end of the stock roll to facilitate insertion therein of the extension rod member 138 of the other holder portion 92 (this is the reason why one of the spindle members preferably is longer than the other as shown). Insertion of the extension rod member into the spindle member 94 rigidly interconnects or couples the spindle members of the holder portions to form the composite spindle 142. Over insertion of the holder portion 92 is precluded by engagement of the annular flange 130 on the core insert 98 thereof against the end of the stock roll.

With the stock roll thus mounted with respect to the stock roll holder 40, the end portions of the stock roll holder projecting axially beyond the stock roll 12 may be grasped by an operator or operators to lift the holder and stock roll for loading onto the mounts 40. As the stock roll holder is being lowered into the recesses 122 of the mounts, the spindle members may be rotated as needed to align the pins 118 with the corresponding openings 126 in the bottom legs 124 of the mounts 42. The stock roll then will be ready to have the stock material M unwound therefrom and the plies of stock material separated for passage through the separating mechanism followed by conversion to pad-like cushioning dunnage product by the cushioning conversion machine. As the stock material is payed out from the stock roll, the core inserts will rotate on the spindles. After the stock roll has been spent, the holder may be removed and separated for mounting of a next stock roll.

Figure 9:
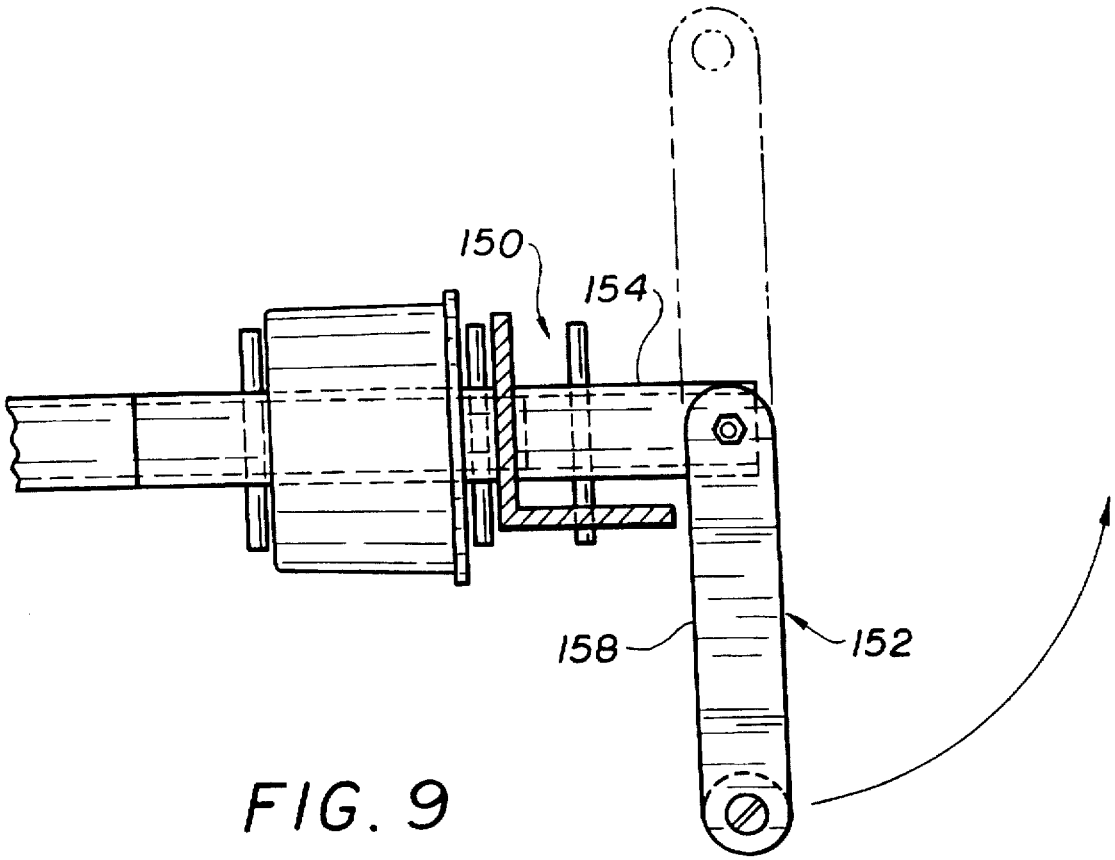
FIG. 9 is a fragmentary elevational view showing a representative swing handle for the stock roll holder.
Figure 10:
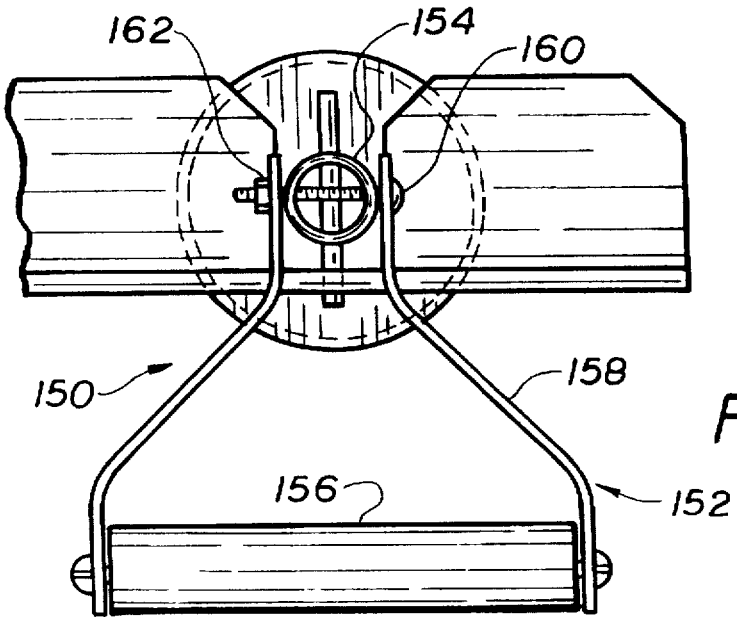
FIG. 10 is an end view of the handle of FIG. 9 shown in its folded down position.

Referring now to FIGS. 9 and 10, an alternative form of spindle member is indicated at 150. The spindle member 150 is identical to the spindle member 96 (FIG. 7) except that the handle 103 has been replaced by a swing handle 152. The swing handle is pivotally connected to the end of a spindle portion 154 of the spindle member for rotation about an axis perpendicular to the axis of the spindle portion 154. As shown, the handle may be in the form of a shovel handle having a transverse gripping portion 156 extending between the distal ends of a clevis or yoke 158 that is attached to the spindle portion by a pivot bolt 160 and nut 162.

In use, the handle 152 may be grasped and swung upwardly as shown in broken lines in FIG. 9 for lifting of a stock roll. After a stock roll has been loaded onto stock roll supports, the handle may be folded out of the way. Preferably the handle swings about a horizontal axis such that when released it will swing under the influence of gravity to an out of the way position, either downwardly as shown in FIGS. 9 and 10 or upwardly and over top the spindle portion.

In similar manner the spindle member at the other end of the holder may be, equipped with a swing handle and the handles at opposite ends of the holder may be used to facilitate loading of a stock roll and then swung out of the way.

Figure 11:
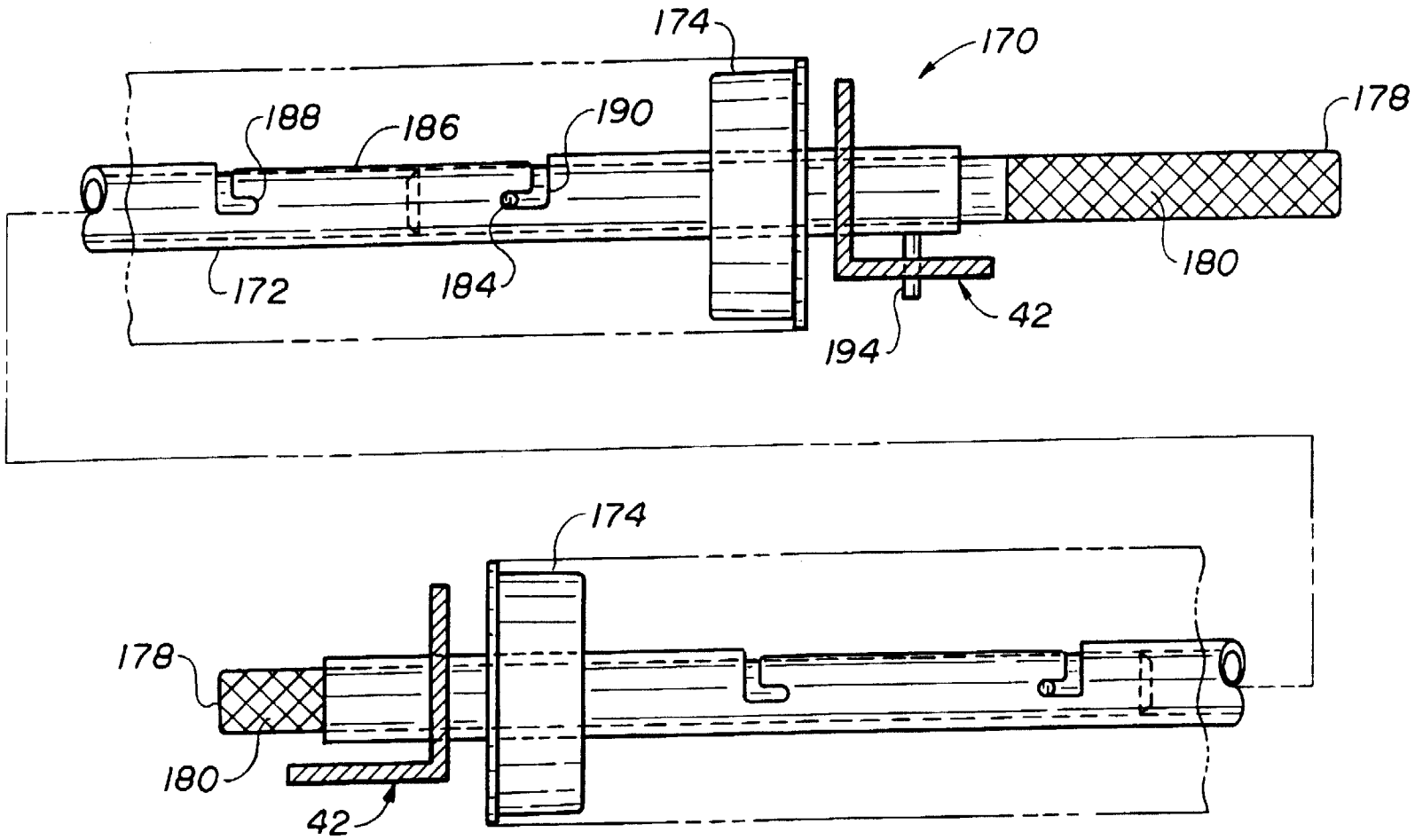
FIG. 11 is a fragmentary elevational view of another embodiment of the stock roll holder having telescopically retractable handles.
Figure 12:
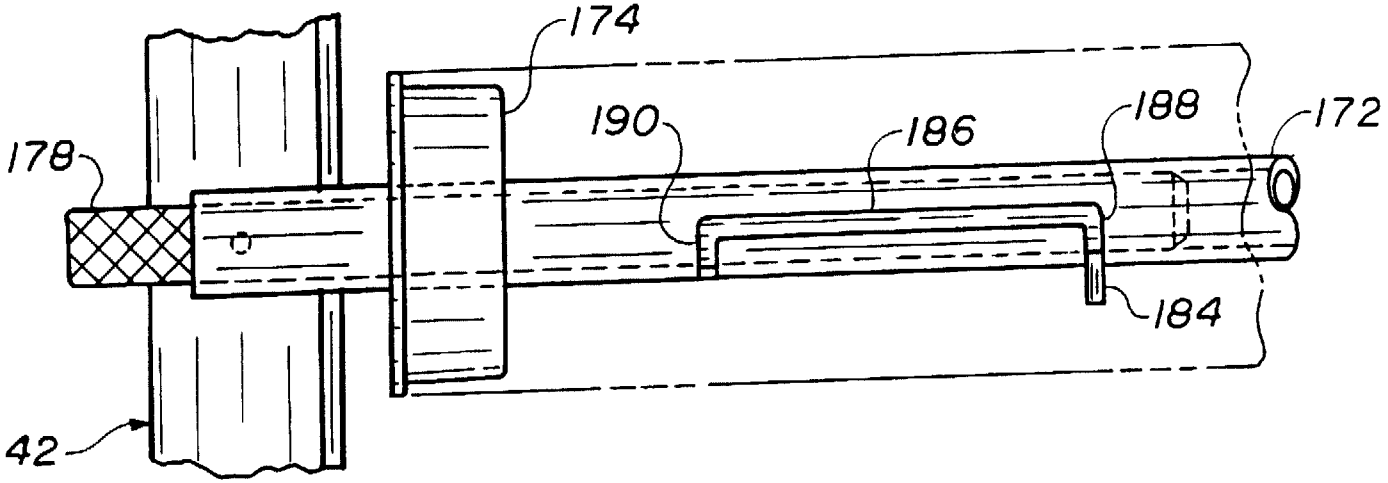
FIG. 12 is a fragmentary plan view of the stock roll holder of FIG. 11.

Referring now to FIGS. 11 and 12, another embodiment of stock roll holder according to the invention is indicated at 170. In this embodiment the stock roll holder 170 includes a single piece spindle or axle 172 that may be used with the prior art plastic plugs 174 inserted in the ends of a stock roll core tube. Alternatively, the spindle may be bifurcated to form a pair of spindle members that may be 25 interengaged at their axially inner ends and which may be equipped with core inserts substantially as above described.

Each end of the spindle 172 is equipped with a telescoping handle 178 shown extended at the right and retracted at the left in FIG. 11. The outer or gripping portion 180 of the handle may be knurled as shown or otherwise provided with gripping enhancing means.

Each handle also has an axially inner portion extending into the adjacent end of the spindle with a close sliding fit. Provided on this inner end portion is a radially outwardly extending pin 184 which is movable in an axially extending slot 186. The ends of the slot 186 limit axial travel of the pin and thereby limit axial extension and retraction of the handle 178. Preferably, the slot intersects at opposite ends thereof respective L-shape slots 188 and 190 which function to lock the handle in its retracted and extruded positions, respectively. Each L-shape slot has a circumferential leg portion extending from the slot 186 to an axial leg portion which extends in a direction towards the other L-shape slot.

In use, each handle 178 may be extended from the ends of the spindle 172 by axially pulling the same outwardly. When the pin 184 is aligned with the circumferential leg of the axially outermost slot 190, the handle can be rotated (90° in the illustrated embodiment) to align the pin with the axial leg of the slot and then shifted axially inwardly with the pin moving into the axial leg to lock the handle against rotation. If desired, the axial leg may be oppositely directed in relation to the circumferential leg. Also, a spring or other biasing device may be provided, such as internally of the spindle, for normally biasing the handle outwardly or inwardly to maintain the pin engaged in the axial leg of the L-shape slot. At this point the handle is extended to permit grasping for loading a stock roll onto a conversion machine.

After the spindle is supported on the machine substantially as above described (a pin 194 preferably is stud welded or otherwise secured to the spindle to prevent rotation of the spindle in the mounts therefor), the handles may be moved out of the way by telescopically retracting them into the spindle. This is done by shifting each handle axially to disengage the pin 184 from the axial leg of the slot 190 and then rotating the handle to align the pin with the axial shot 186. The handle is then moved axially inwardly to align the pin with the circumferential leg of the axially innermost slot 188. The handle is then rotated to move the pin into alignment with the axial leg of the slot 188 after which the handle may be shifted axially to engage the pin in the axial leg thereby to lock the handle against rotation. In the illustrated embodiment the handle has a stroke of about 11 cm (4.3 inches).

As will be appreciated from the foregoing description, the present invention eliminates the need for the previously used plastic plugs and/or provides for easier loading of stock rolls onto stock roll supports of cushioning conversion machines.

Although the invention has been shown and described with respect to several preferred embodiments, it will be apparent that equivalent alterations and modifications will occur to others skilled in the art upon the reading and understanding of this specification. For example, the present invention broadly encompasses arrangements, even though less preferred, wherein the spindle members may not be joined at their axially inner ends, or where an axially elongated or multiple core insert members are carried on only one of the spindle members with only an axial stop being carried on the other spindle member or installable on said one spindle member to axially confine the stock roll. The present invention includes all such equivalent alterations and modifications, and is limited only by the scope of the following claims.

What is claimed:

1. A dunnage-creating machine for producing dunnage product from sheet-like stock material supplied as a roll having a hollow core, said dunnage-creating machine comprising conversion assemblies for converting the sheet-like stock material into a three-dimensional cushioning product, and a stock roll support assembly for rotatably supporting a roll of sheet-like stock material from which the sheet-like stock material is payed off for conversion by the machine into a dunnage product, said stock roll support assembly comprising a pair of laterally spaced apart mounts and a stock roll holder having opposite end portions removably supported on said mounts, said stock roll holder including first and second holder portions each including a respective spindle member having an axially outer portion forming a respective one of said opposite end portions, a core insert rotatably supported on and axially carried by said spindle member for telescopic insertion into the stock roll core at an adjacent end thereof thereby to support the stock roll for rotation with said core insert, and an axial abutment axially carried on said spindle member axially outwardly of said core insert and projecting radially outwardly beyond said core insert to form an abutment for engaging the adjacent end of the stock roll core thereby to limit axial outward movement of the stock roll core relative to said spindle member.

2. A combination as set forth in claim 1, wherein said core inserts are rotatably supported on said spindle members by bearing structure.

3. A combination as set forth in claim 2, wherein said core inserts include a tubular body of a plastic bearing material having a center hole through which said spindle portions extend.

4. A combination as set forth in claim 3, wherein said tubular body has at an axially outer end thereof an annular radially outwardly projecting flange forming said axial abutment.

5. A combination as set forth in claim 1, wherein said spindle members have handle grips at the axially outer end portions thereof.

6. A combination as set forth in claim 1, wherein said spindle members have thereon axial stops adjacent axially inner and outer ends of said core inserts for limiting axial movement of said core inserts relative to said spindle members.

7. A combination as set forth in claim 1, wherein said spindle members have interference means coacting with said mounts to prevent rotation of said spindle members relative to said mounts.

8. A combination as set forth in claim 1, wherein said machine includes a frame and said mounts are mounted to said frame.

9. A combination as set forth in claim 1, wherein said mounts are carried on a mobile carrier that may be moved to and from said machine.

10. A combination as set forth in claim 1, wherein said spindle members are adapted to be coupled together to form a composite spindle supported at opposite ends thereof in said mounts.

11. A combination as set forth in claim 1, comprising a separating mechanism for separating multiple plies of sheet-like stock material payed off of the stock roll.

12. A dunnage-creating machine for producing dunnage product from sheet-like stock material supplied as a roll having a hollow core, said dunnage-creating machine comprising conversion assemblies for converting the sheet-like stock material into a three-dimensional cushioning product, and a stock roll support assembly for rotatably supporting a roll of sheet-like stock material from which the sheet-like stock material is payed off for conversion by the machine into a dunnage product, said stock roll support assembly including a pair of laterally spaced apart mounts and a stock roll holder having opposite end portions removably supported on said mounts, said stock roll holder including a composite spindle composed of two separable spindle members having axially outer portions respectively forming said opposite end portions, and a stock roll core support rotatably supported on said composite spindle and axially carried by at least one of said separable spindle members, each spindle member axially carrying thereon an abutment for engaging a respective end of the stock roll to limit axially outward movement of the stock roll relative to said spindle member.

13. A combination as set forth in claim 12, wherein said spindle members having axially inner end portions configured for axially telescoping interconnection.

14. A combination as set forth in claim 12, wherein one of said spindle members is longer than the other, thereby to position the axially inner end thereof in close proximity to the end of the stock roll opposite the end from which the longer spindle member is inserted into the hollow core of the stock roll.

15. A combination as set forth in claim 12, wherein said stock roll core support includes a pair of core inserts rotatably supported on and axially carried by said spindle members, respectively.

16. A combination as set forth in claim 15, wherein each core insert includes a tubular body of a plastic bearing material having a center hole through which said spindle portions extend.

17. A combination as set forth in claim 12, wherein said spindle members each include a swing handle at the outer ends thereof.

18. A combination as set forth in claim 12, wherein said spindle members each include a telescopically extendable and retractable handle.

19. A method for loading and supporting a hollow core stock roll in operative relation to a dunnage-creating machine for producing dunnage product from sheet-like stock material payed off of the stock roll, comprising the steps of inserting first and second spindle members into the hollow core of the stock roll from opposite ends of the stock roll while leaving axially outer end portions of said spindle members projecting beyond the axial ends of the stock roll, and supporting the projecting end portions of the spindle members in laterally spaced apart mounts.

20. A method as set forth in claim 19, including the step of using core inserts axially carried on the spindle members for rotatably supporting the stock roll on the spindle members.

21. A method as set forth in claim 19, including the step of positioning axially outwardly of the ends of the stock roll axial stops for limiting axially outer movement of the stock roll relative to the spindle members when supported on the mounts.

22. A method as set forth in claim 19, including the step of coupling together the first and second spindle members when the latter are inserted into opposite ends of the stock roll core to form a composite spindle that will supported at opposite end portions thereof when the spindle members are supported by the mounts.

23. A method as set forth in claim 22, wherein said coupling step includes telescopically interconnecting axially inner end portions of the spindle members.

24. A method as set forth in claim 19, further comprising the step of separating multiple plies of sheet-like stock material payed off of the stock roll prior to conversion by the machine into a dunnage product.

25. In a dunnage-creating machine, conversion assemblies for converting sheet-like stock material into a three-dimensional cushioning product, a spindle for supporting a stock roll, a pair of mounts on which portions of the spindle are supported, and a handle movably connected to each end of said spindle for facilitating lifting of said spindle, the handle being movable relative to said portions of the spindle supported on the mounts.

26. In a dunnage-creating machine, conversion assemblies for converting sheet-like stock material into a three-dimensional cushioning product, a spindle for supporting a stock roll, a pair of mounts on which portions of the spindle are supported and telescopically extendable and retractable handle at each end of said spindle, the handle being movable relative to said portions of the spindle supported on the mounts.

27. A method of converting sheet-like stock material into a dunnage product, said method comprising the steps of:

supplying the sheet-like stock material in a plurality of rolls which each have a hollow core;

providing a stock roll support assembly including a pair of core inserts rotatably mounted on respective spindles having handle portions;

inserting the core inserts into the opposite ends of the hollow core of a first one of the plurality of stock rolls;

using the handle portions to load the first stock roll at an appropriate conversion position;

converting the first stock roll into a dunnage product until all of the stock material has been payed off whereby only the hollow core of the first stock roll remains on the stock roll support assembly;

withdrawing the core inserts from the hollow core of the first stock roll;

removing the hollow core of the first stock roll from the conversion position; and repeating the inserting, using, converting, withdrawing, and removing steps for each of the plurality of rolls of sheet-like stock material.

28. A cushioning conversion machine for converting a sheet-like stock material supplied in rolls into a three-dimensional dunnage product;

said machine comprising conversion assemblies for converting the sheet-like stock material into the three-dimensional dunnage product, and a stock roll support assembly for rotatably supporting a roll of sheet-like stock material payed off for conversion by the conversion assemblies;

the stock roll support assembly comprising a pair of laterally spaced apart mounts and a stock roll holder removably supported on the mounts;

the stock roll holder including a spindle for supporting the stock roll and a handle connected to each end of the spindle; and each handle including a yoke connected to the spindle and a transverse gripping portion extending between the distal ends of the yoke, wherein the yoke is movably connected to the spindle.

29. A cushioning conversion machine as set forth in claim 28, wherein the stock roll holder further includes a pair of core inserts rotatably mounted on the spindle, the core inserts being sized and positioned for insertion into the ends of the hollow core of the stock roll.

30. A cushioning conversion machine set forth in claim 28, for converting a sheet-like stock material supplied in rolls into a three-dimensional dunnage product;

said machine comprising conversion assemblies for converting the sheet-like stock material into the three-dimensional dunnage product, and a stock roll support assembly for rotatable supporting a roll of sheet-like stock material payed off for conversion by the conversion assemblies;

the stock roll support assembly comprising a pair of laterally spaced apart mounts and a stock roll holder removably supported on the mounts;

the stock roll holder including a spindle for supporting the stock roll and a handle connected to each end of the spindle; and each handle including a yoke connected to the spindle and a transverse gripping portion extending between the distal ends of the yoke, wherein the yoke is pivotally connected to the spindle.

31. A cushioning conversion machine for converting a sheet-like stock material supplied in rolls into a dunnage product;

said machine comprising conversion assemblies for converting the sheet-like stock material into the dunnage product, and a stock roll support assembly for rotatably supporting a roll of sheet-like stock material payed off for conversion by the conversion assemblies;

the stock roll support assembly comprising a pair of laterally spaced apart mounts and a stock roll holder removably supported on the mounts;

the stock roll holder including a spindle for supporting the stock roll and a handle connected to each end of the spindle; and each handle including a yoke connected to the spindle and a transverse gripping portion extending between the distal ends of the yoke.

wherein the yoke is pivotally connected to the spindle;

wherein the yoke is pivotally connected for rotation about an axis perpendicular to the axis of the spindle whereby the handles may be pivoted to a substantially horizontal position for loading of a stock roll and may be pivoted to a substantially vertical position during operation of the machine.

32. A cushioning conversion machine for converting a sheet-like stock material supplied in rolls into a dunnage product;

said machine comprising conversion assemblies for converting the sheet-like stock material into the dunnage product, and a stock roll support assembly for rotatably supporting a roll of sheet-like stock material payed off for conversion by the conversion assemblies;

the stock roll support assembly comprising a mounting structure and a stock roll holder removably supported on the mounting structure;

the stock roll holder including a spindle for supporting the stock roll and a handle on each end of the spindle;

the handles being telescopically extendable/retractable relative to the spindle whereby they may be extended for loading of a stock roll and may be retracted during operation of the machine.

33. A cushioning conversion machine as set forth in claim 32, wherein the stock roll holder further includes a pair of core inserts rotatably mounted on the spindle, the core inserts being sized and positioned for insertion into the ends of the hollow core of the stock roll.

34. A cushioning conversion machine for converting a sheet-like stock material supplied in rolls into a dunnage product;

said machine comprising conversion assemblies for converting the sheet-like stock material into the dunnage product, and a stock roll support assembly for rotatably supporting a roll of sheet-like stock material from which the sheet-like stock material is saved off for conversion by the conversion assemblies;

the stock roll support assembly comprising a mounting structure and a stock roll holder removably supported on the mounting structure:

the stock roll holder including a spindle for supporting the stock roll and a handle on each end of the spindle;

the handles being telescopically extendable/retractable relative to the spindle whereby they may be extended for loading of a stock roll and may be retracted during operation of the machine: and wherein the outer portion of each handle is provided with grip enhancements.

35. A mobile cart for use with a dunnage-creating machine that products a dunnage product from sheet-like stock material supplied as a roll having a hollow core:

the cart including a support structure, a set of wheels attached to the support structure to provide mobility, a pair of laterally spaced apart stock roll mounts also attached to the support structure, and a stock roll holder removably supported on the mounts:

the stock roll holder including a spindle, handle portions projecting from the outer ends of the spindle, and a pair of core inserts rotatable mounted on the spindle;

the spindle extending through, and the handle portions extending beyond, the stock roll mounts: and the core inserts being positioned on the spindle for insertion into the hollow core of the stock roll:

wherein the handle portions are telescopically extendable/retractable relative to the spindle whereby the handle portions may be extended during loading of the stock roll and retracted during operation of the dunnage-creating machine.

36. A mobile cart for use with a dunnage-creating machine that products a dunnage product from sheet-like stock material supplied as a roll having a hollow core:

the cart including a support structure, a set of wheels attached to the support structure to provide mobility, a pair of laterally spaced apart stock roll mounts also attached to the support structure, and a stock roll holder removably supported on the mounts:

the stock roll holder including a spindle, handle portions projecting from the outer ends of the spindle, and a pair of core inserts rotatable mounted on the spindle:

the spindle extending through, and the handle portions extending beyond, the stock roll mounts: and the core inserts being positioned on the spindle for insertion into the hollow core of the stock roll:

wherein the handle portions are pivotally connected to the spindle whereby the handle portions may be pivoted to one position for loading of the stock roll and pivoted to another position during operation of the dunnage-creating machine.

37. A cushioning conversion machine for making a cushioning product by converting a sheet-like stock material of one or more plies supplied in rolls into a three-dimensional cushioning product comprising conversion assemblies and a stock roll support assembly for rotatably supporting the roll of sheet-like stock material from which the sheet-like stock material is payed off for conversion into a three-dimensional cushioning product by the conversion assemblies;

the stock roll support assembly including at least one mount and a stock roll holder removably supported thereon;

the stock roll holder including at least one spindle for supporting the stock roll, at least one core insert rotatably supported on and axially carried by said spindle member for insertion into the stock roll thereby to support the stock roll at opposite ends thereof for rotation with said core insert, and an axial abutment axially carried on said spindle member in an axially fixed position relative to the spindle member and a removable axial abutment attached to the opposite end of the stock roll holder, both axial abutments being axially outward of said core insert and projecting radially outwardly beyond said core insert to form an abutment for engaging the adjacent end of the stock roll core thereby to limit axial outward movement of the stock roll core relative to said spindle and a handle connected to each end of the spindle.

38. A cushioning conversion machine of claim 37, wherein the outer portion of each handle is provided with grip enhancements.

* * * * *